US007008101B2

(12) United States Patent
Qureshi

(10) Patent No.: US 7,008,101 B2
(45) Date of Patent: Mar. 7, 2006

(54) METHOD AND APPARATUS FOR REPRODUCIBLE DISSOLUTION TESTING OF PHARMACEUTICAL PRODUCTS

(75) Inventor: Saeed A. Qureshi, Nepean (CA)

(73) Assignee: Her Majesty the Queen in right of Canada, as represented by the Minister of Health, Ottawa (CA)

( * ) Notice: Subject to any disclaimer, the term of this patent is extended or adjusted under 35 U.S.C. 154(b) by 212 days.

(21) Appl. No.: 10/608,474

(22) Filed: Jun. 30, 2003

(65) Prior Publication Data

US 2003/0235110 A1 Dec. 25, 2003

Related U.S. Application Data

(63) Continuation-in-part of application No. 10/100,134, filed on Mar. 19, 2002, now Pat. No. 6,676,285.

(30) Foreign Application Priority Data

Sep. 26, 2001 (CA) ..... 2358575

(51) Int. Cl.
*B01F 7/00* (2006.01)

(52) U.S. Cl. ..... 366/279; 366/325.2; 366/348

(58) Field of Classification Search ..... 366/343, 366/309, 310, 311, 312, 313, 279, 349, 325.2, 366/348
See application file for complete search history.

(56) References Cited

U.S. PATENT DOCUMENTS

| | | | | |
|---|---|---|---|---|
| 355,054 | A | | 12/1886 | Bennett |
| 444,710 | A | | 1/1891 | McPherson |
| 519,948 | A | | 5/1894 | Hahn |
| 525,138 | A | | 8/1894 | Detwiler |
| D28,707 | S | | 5/1898 | Whittemore |
| 614,305 | A | | 11/1898 | Jones |
| 671,516 | A | | 4/1901 | Hegner |
| 772,302 | A | | 10/1904 | Widness |
| 839,714 | A | * | 12/1906 | Blanchat ..... 366/312 |
| 902,577 | A | | 11/1908 | Hall |
| 922,458 | A | | 5/1909 | Clarkson |
| 1,014,236 | A | | 1/1912 | Lawhon |
| 1,317,523 | A | | 9/1919 | Meyer et al. |
| 1,417,965 | A | | 5/1922 | Belcher |
| 1,486,626 | A | | 3/1924 | Betley |

(Continued)

FOREIGN PATENT DOCUMENTS

CA 1038858 9/1978

(Continued)

OTHER PUBLICATIONS

Patent Abstracts of Japan, JP-09-1500046, Published Jun. 10, 1997, 2 pgs.

(Continued)

*Primary Examiner*—Tony G. Soohoo
(74) *Attorney, Agent, or Firm*—Kent Daniels; Ogilvy Renault, LLP

(57) ABSTRACT

In a method for reproducible dissolution of a pharmaceutical product in a dissolution medium contained within a vessel, a flow regime characterized by high turbidity and low bulk movement of dissolution medium is induced within the vessel. Simultaneously, solid particles of the pharmaceutical product on a bottom portion of the vessel are mechanically dispersed. Induction of the flow regime and mechanical dispersion of solid particles may be accomplished by a brush body adapted to sweep a bottom portion of the vessel. The brush body is repeatably biased into contact with the bottom portion of the vessel, and caused to rotate in a controlled manner.

9 Claims, 4 Drawing Sheets

U.S. PATENT DOCUMENTS

| | | | | | |
|---|---|---|---|---|---|
| 1,507,971 | A | | 9/1924 | Lomp | |
| 1,564,388 | A | | 12/1925 | Westvig | |
| 1,652,213 | A | | 12/1927 | Pulver | |
| 1,678,943 | A | | 7/1928 | Jackson | |
| 1,728,637 | A | * | 9/1929 | Stoelting | 366/343 |
| 1,774,910 | A | * | 9/1930 | William | 366/309 |
| 1,831,684 | A | | 11/1931 | Peterson | |
| 2,018,086 | A | | 10/1935 | Parsons | |
| 2,047,317 | A | * | 7/1936 | Esslen | 366/309 |
| 2,047,318 | A | * | 7/1936 | Esslen | 366/312 |
| 2,214,684 | A | | 9/1940 | Stinnett | |
| 2,420,260 | A | | 5/1947 | Myszkowski | |
| 2,432,924 | A | | 12/1947 | Nishizaka et al. | |
| 2,488,053 | A | * | 11/1949 | Damrow | 366/312 |
| 2,513,719 | A | | 7/1950 | Glass | |
| 2,529,952 | A | | 11/1950 | Leunis | |
| 2,546,285 | A | | 3/1951 | Wittman | |
| 2,675,572 | A | | 4/1954 | Komiya | |
| 2,839,771 | A | | 6/1958 | Hunter | |
| 2,878,501 | A | | 3/1959 | Brennan | |
| 3,132,849 | A | * | 5/1964 | Kritikson | 366/312 |
| 3,451,723 | A | | 6/1969 | Marks | |
| 3,750,214 | A | | 8/1973 | Calliendo et al. | |
| 3,862,461 | A | | 1/1975 | Bucklitzsch | |
| 3,991,983 | A | | 11/1976 | Drynan | |
| 4,197,018 | A | | 4/1980 | Groen, Jr. | |
| 4,630,932 | A | | 12/1986 | Revelli et al. | |
| 4,827,455 | A | | 5/1989 | Balovnev et al. | |
| 4,884,895 | A | | 12/1989 | Rodgers | |
| 5,037,210 | A | | 8/1991 | Bliss | |
| 5,094,604 | A | | 3/1992 | Chavez et al. | |
| 5,339,480 | A | | 8/1994 | Murg et al. | |
| 5,533,804 | A | * | 7/1996 | Larsson et al. | 366/274 |
| 5,608,938 | A | | 3/1997 | Baschenis | |
| 5,908,241 | A | | 6/1999 | Bliss et al. | |

FOREIGN PATENT DOCUMENTS

| | | |
|---|---|---|
| CA | 1052766 | 4/1979 |
| DE | 622 247 C | 11/1935 |
| GB | 1025893 | 4/1966 |

OTHER PUBLICATIONS

Patent Abstracts of Japan, JP-07-232047, Published Sep. 5, 1995, 2 pgs.

Patent Abstracts of Japan, JP-57-053229, Published Mar. 30, 1982, 2 pgs.

Patent Abstracts of Japan, JP-57-004218, Published Jan. 9, 1982, 2 pgs.

Patent Abstracts of Japan, JP-55-099328, Published Jul. 29, 1979, 2 pgs.

Patent Abstracts of Japan, JP-07-108152, Published Oct. 15, 1993, 2 pgs.

International Search Report of PCT/CA02/01452, 4 pages, Jan. 31, 2003.

* cited by examiner

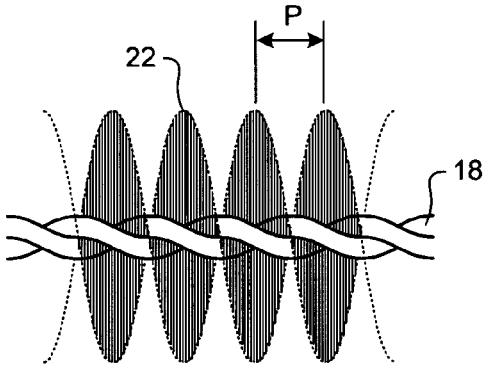
Figure 3a
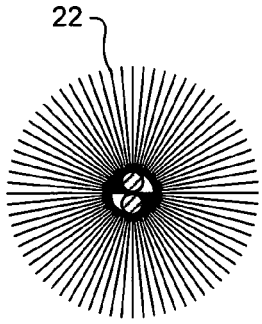
Figure 3b
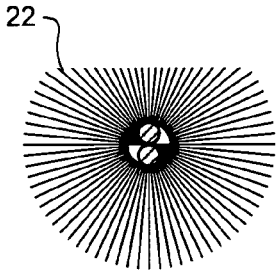
Figure 3c
Figure 4
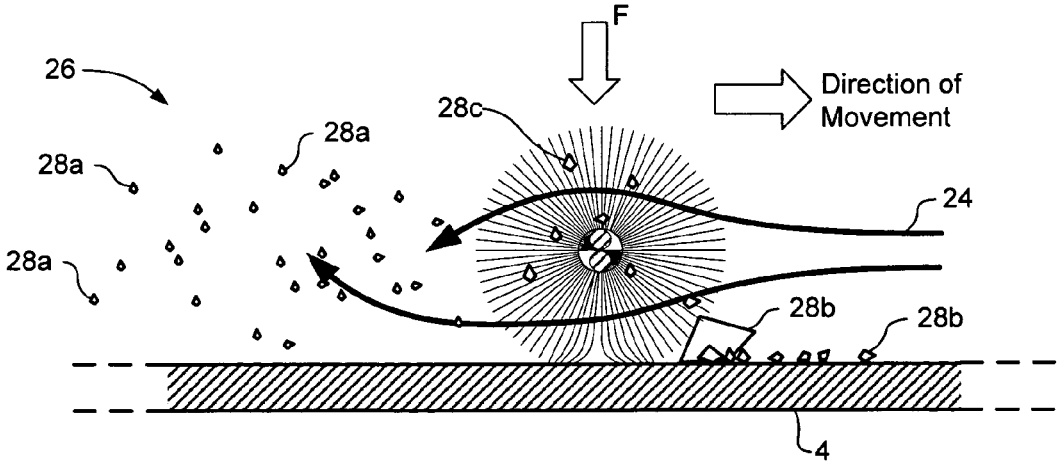

METHOD AND APPARATUS FOR REPRODUCIBLE DISSOLUTION TESTING OF PHARMACEUTICAL PRODUCTS

CROSS-REFERENCE TO RELATED APPLICATIONS

This application is a Continuation-in-part of U.S. patent application Ser. No. 10/100,134 filed Mar. 19, 2002 now U.S. Pat No. 6,676,285. This application is also based on, and claims priority of, Canadian Patent Application No. 2,358,575 filed on Sep. 26, 2001.

MICROFICHE APPENDIX

Not Applicable.

TECHNICAL FIELD

The present invention relates to the field of dissolution measurement and, more particularly, to methods and apparatus for reproducible dissolution testing of pharmaceutical products.

BACKGROUND OF THE INVENTION

A solid pharmaceutical product, such as a tablet or capsule, is generally composed of a mixture of active ingredient (s) and excipient (i.e., pharmacologically inactive ingredients) compressed into a desired shape. When the product is administered to a patient, it is expected that the active ingredient will be released into the gastrointestinal (GI) tract in a predictable and reproducible manner. There are a number of factors which can alter the drug release characteristics of a product, and consequently the outcome in a patient. These factors include, but are not necessarily limited to: the nature and composition of active and inactive ingredients; the manufacturing process; and/or storage conditions. Federal regulations in many countries require pharmaceutical companies to determine the drug release characteristics of any new pharmaceutical product.

The methodology used to assess the drug release characteristics of a pharmaceutical product in humans is known as a bio-availability and/or bio-equivalence study, also commonly termed as a "bio-study". A bio-availability study follows a predetermined protocol, in which a pharmaceutical product is administered to a human volunteer, and a number of blood samples are withdrawn at different time intervals. These blood samples are then analyzed to determine the level of active ingredient in the volunteer's blood. The resulting blood concentration vs. time profiles are used to assess the bio-availability and bio-equivalence of the pharmaceutical product. The profiles are also used to establish the extent and rate of drug release and absorption, and can be compared to corresponding profiles obtained from different products. This is the fundamental concept in the drug release evaluation to establish safety, efficacy and quality aspects of a drug product. Any time that a new product is developed; significant changes are made to an existing product; or the manufacturing process is altered, the drug release characteristics of the products must be re-established.

As may be appreciated, in-vivo bio-studies of the type described above tend to be expensive and time consuming. Furthermore, ethical concerns can severely limit the desirability of these studies in humans. Consequently, an in-vitro drug release evaluation test is desirable as a low-cost/low-risk alternative. Various protocols have been developed for conducting such in-vitro dissolution tests, and are routinely used for both product development and quality assurance.

Presently, drug dissolution testing is conducted using recommended compendial methods and apparatus, such as the U.S. Pharmacopoeia. Four different types of apparatus, based on different mixing methods are commonly available commercially and have compendial recognition. These apparatuses are known as: paddle; basket; flow-through; and reciprocating cylinder.

Of the four types of apparatus, the paddle apparatus is the most commonly used. Several standard paddle-type drug dissolution testing apparatus are known, such as those manufactured by Varian Inc., Distek Inc. and others. As may be seen in FIG. 1, such testing apparatus 2 typically provide between 6 and 12 substantially identical vessels 4 (only one is shown in FIG. 1), so that multiple parallel dissolution tests may be conducted simultaneously. A drive unit 6 provides a spindle 8 designed to support a respective T-shaped paddle 10 within each vessel 4, and a drive motor (not shown) for rotating each spindle 8 at a desired speed of between about 50 and 100 rpm.

While exact protocols and apparatus vary, all drug dissolution test methods involve placing the pharmaceutical product into an aqueous dissolution medium (e.g. water and/or buffers), and applying some form of agitation to the dissolution medium in order to promote disintegration and dissolution of the product under test. In the case of the paddle-type of apparatus of FIG. 1, the pharmaceutical product is placed into an aqueous dissolution medium 12 within a vessel 4, and agitation to the dissolution medium is achieved by rotating a paddle 10 at a speed of between 50 and 100 rpm. At specific times, samples of the dissolution medium 12 are withdrawn and the percentage of dissolved active ingredient determined using any of the conventional analytical methods, such as UV or liquid chromatography. Cumulative drug release as a percentage of the dosage strength is then calculated and reported, describing the drug release characteristic in vitro. The concentration vs. time profiles can be used to gauge of the rate of dissolution of the pharmaceutical product. The logic behind assessing the drug release in water or aqueous buffer solution is that, if a drug is to be absorbed from the GI tract into the systemic circulation, the drug has to be in a solution form. Thus, knowledge of the drug dissolution rate should, at least in theory, be usable as a proxy for the bio-availability.

In principle, drug dissolution testing should provide an alternative to bio-availability studies in humans that is fast, safe and low cost. However, all of the prior art dissolution testing methods suffer a limitation in that they are fundamentally non-reproducible. Successive tests with samples of the same pharmaceutical product (even within the same production lot), and using the same type of test apparatus and protocol, can yield widely differing results. The disparity can be mitigated, to some degree, by use of automation to eliminate human factors influencing the test protocol, and by averaging results over a very large number of product samples. However, even with these measures, the standard deviation of the test results can still be so wide as to prevent statistically valid comparison between different pharmaceutical products, or even between different production lots of the same product. In some cases, successive tests using identically the same test apparatus will produce self-consistent (and thus repeatable) test results. However, these results will generally not correlate well with test results produced by another test apparatus, even when the two devices are manufactured to identical specifications, by the same company.

Furthermore, it would be highly desirable for drug dissolution test results of a product to at least roughly correlate to those of the bio-studies of the same product. For example, it would be desirable for the concentration vs. time profile produced by the drug dissolution test to at least roughly correlate with the corresponding concentration vs. time profile produced by the corresponding bio-availability study. Such correlation would enable the rate of dissolution found during a dissolution test to be used as an indicator of the dissolution rate in the GI tract. However, in most cases, dissolution test results cannot be correlated with bio-studies of the same product in any statistically valid manner.

The source of non-repeatability and non-reproducibility in conventional drug dissolution testing apparatus depends of the type of apparatus used. In the case of the paddle apparatus shown in FIG. 1, a major source of error lies in the fact that the paddle 10 efficiently transfers rotary motion to the surrounding dissolution medium 12. Consequently, during a dissolution test, the paddle 10 induces bulk rotation of the dissolution medium 12 within the vessel 4 (as shown by dashed arrows in FIG. 1). Over time, the bulk rotation speed of the dissolution medium progressively increases towards that of the paddle 10, with a commensurate decrease in fluid turbidity. The bulk movement and reduced turbidity of dissolution medium causes particles of disintegrated (but undissolved) test product to accumulate in a mound 14 at the bottom of the vessel 4. The size of the mound 14 is influenced by many factors, including the precise shape of the mixing vessel. In the case of glass mixing vessels, which are typically hand-blown, normal manufacturing variations can produces noticeable variations in the observed size of the mound 14. The presence of a mound 14 of un-dissolved product reduces interaction between the solid particles and the dissolution medium 12, which leads to artificially low dissolution rates. Since the size distribution of particles varies randomly from test to test, the actual effect in each case is a statistical quantity that is inherently non-repeatable.

The lack of turbidity and presence of a mound 14 of undissolved product are also important factors that prevent correlation between results drug dissolution tests and bio-studies of the same product. In particular, the action of the GI tract tends to produce high turbidity, but very little bulk movement, of gastric fluids. Furthermore, disintegrated solid particles do not accumulate within the GI tract, but rather are rapidly dispersed. While the dissolution medium used in dissolution tests can be (and frequently is) chemically similar to typical gastric fluids, the fluid conditions (e.g. low turbidity, high bulk movement, high particle accumulation) within the conventional dissolution test apparatus are entirely different from those of the GI tract.

Accordingly, a technique for reproducible and physiologically relevant dissolution testing of pharmaceutical products remains highly desirable.

SUMMARY OF THE INVENTION

An object of the present invention is to provide a method for reproducible dissolution testing of pharmaceutical products.

Thus, an aspect of the present invention provides a method for controlled dissolution of a pharmaceutical product in a dissolution medium contained within a vessel. According to the invention, a flow regime characterized by high turbidity and low bulk movement of dissolution medium is induced within the vessel. Simultaneously, solid particles of the pharmaceutical product on a bottom portion of the vessel are mechanically dispersed.

In preferred embodiments, induction of the flow regime and mechanical dispersion of solid particles is accomplished by providing a brush body adapted to sweep a bottom portion of the vessel. The brush body is repeatably biased into contact with the bottom portion of the vessel, and caused to rotate in a controlled manner.

BRIEF DESCRIPTION OF THE DRAWINGS

Further features and advantages of the present invention will become apparent from the following detailed description, taken in combination with the appended drawings, in which:

FIGS. 3*a*–3*c* are respective views of a portion of a brush body of the embodiments of FIGS. 2*a* and 2*b;*

FIG. 4 schematically illustrates operation of the brush body of FIGS. 3*a*–3*c.

It will be noted that throughout the appended drawings, like features are identified by like reference numerals.

DETAILED DESCRIPTION OF THE PREFERRED EMBODIMENT

The present invention provides methods and apparatus for controlled, reproducible dissolution of pharmaceutical products in a dissolution medium. Embodiments of the present invention are described below with reference to FIGS. 2–5

Figure 1:
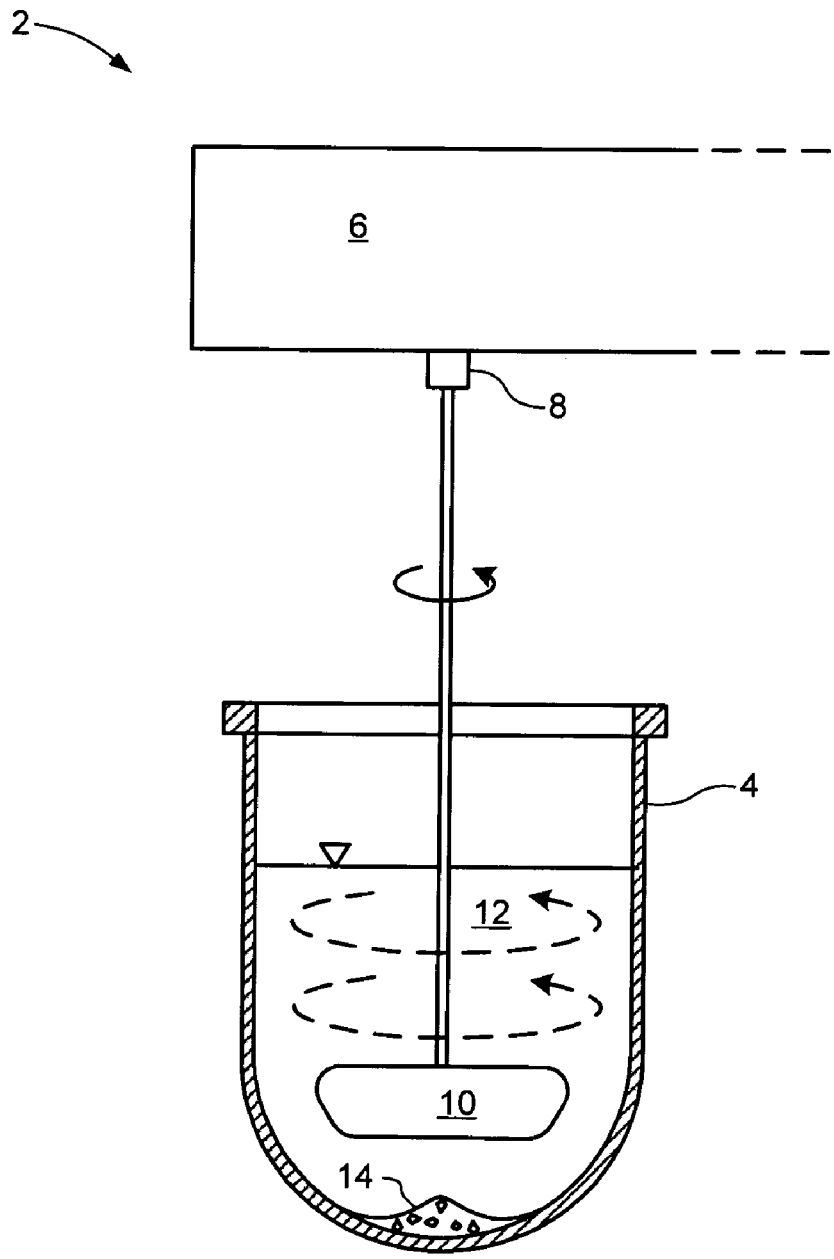
Figure 1 (Prior Art)
FIG. 1 is a sectional view of a prior art paddle mixing apparatus.
Figures 2A, 2B:
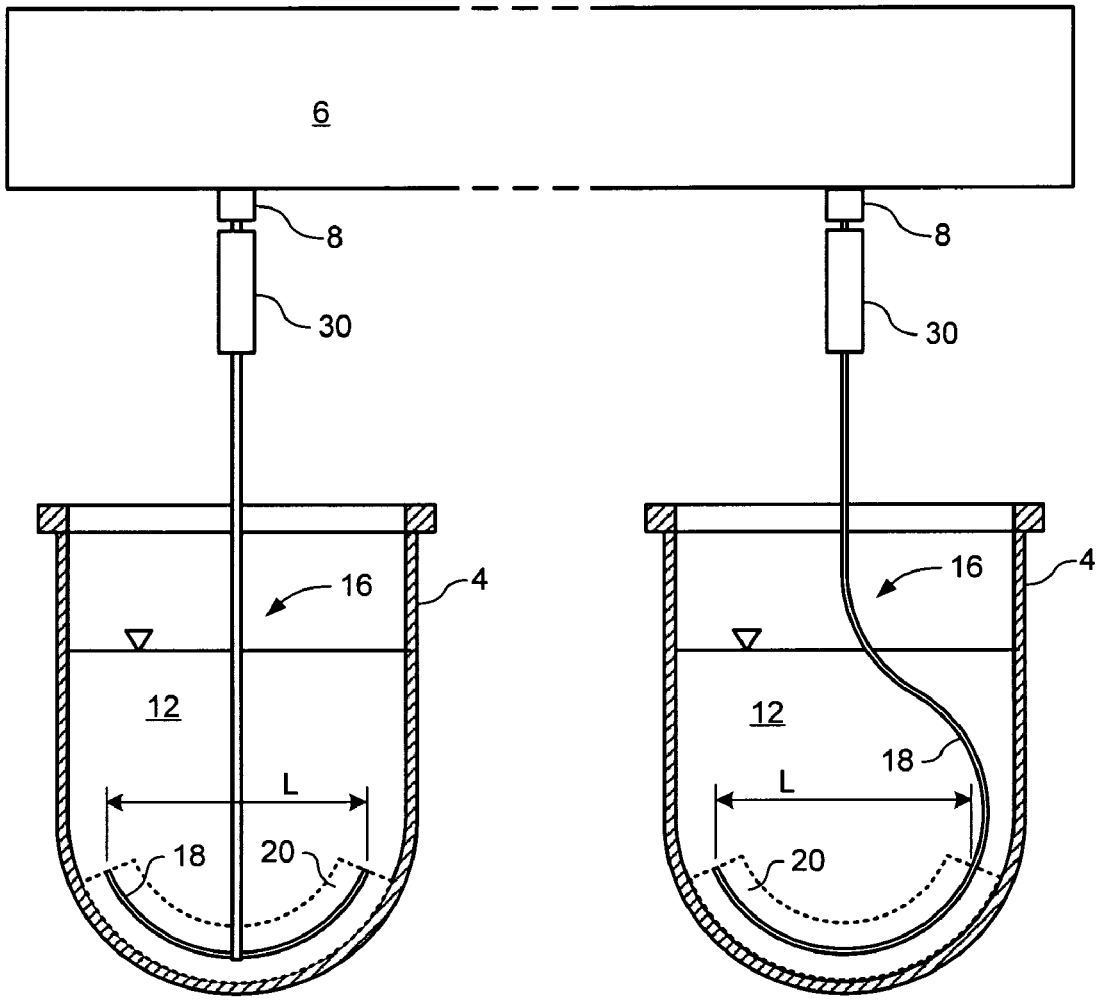
FIGS. 2*a* and 2*b* are sectional views of a mixing device in accordance with respective embodiments of the present invention.

As shown in FIGS. 2*a* and 2*b,* a controlled dissolution apparatus in accordance with the present invention generally comprises a vessel 4 for containing a desired quantity of dissolution medium 12; a stirring element 16 supported within the vessel 4; and a drive unit 6 for driving rotation of the stirring element 16 at a controlled speed. The vessel 4 and drive unit 6 may conveniently be provided as part of a standard paddle-type drug dissolution testing system described above with reference to FIG. 1.

The stirring element 16 comprises a support member 18 and a brush body 20. In the embodiment of FIG. 2*a,* the support member 18 is provided as a generally T-shaped structure, while a hook-shaped support member 18 is shown in FIG. 2*b.* In both cases, the support member 18 is coupled to a spindle 8 of the drive unit 6, and serves to support the brush body 20 in consistent sliding contact with the bottom portion of the vessel 4.

Preferably, the support member 18 at least approximately conforms to the shape of a bottom portion of the vessel 4 and is separated therefrom by a gap. A substantially uniform gap is beneficial, in that it simplifies the design of the brush body 20, but it is not essential.

The support member 18 is preferably comparatively rigid, in order to enable secure coupling to the drive unit 6 and controlled rotation of the brush body 20 within the vessel 4. For this purpose, the support member 18 may conveniently be constructed using two or more strands of wire twisted together, or solid bar stock, as desired. If desired, the support member 18 may be divided into two or more sections, which may be permanently fastened together, or may be detachable, as desired. Preferably, the support member 18 is made of a material that is substantially non-reactive with either the vessel 4 or its contents, so as to not interfere with any desired chemical or biological processes that may take place in the vessel 4. Typical materials usable for the purposes of the present invention include (but are not limited to) stainless steel, polytetrafluoroethylene (PTFE, e.g., TeflonTM), polyamide polymer (e.g., nylon—trade name) or other plastics, or plastic-coated steel.

In accordance with the present invention, the brush body 20 is provided with an open structure which readily admits a flow of dissolution medium 12 as the brush body rotates within the vessel. In general, the length (L) of the brush body 20 will be selected to ensure that the brush body 20 can sweep enough of the bottom portion of the vessel 4 to prevent accumulations of solid particles. In the case of standard round-bottom vessels typically used in paddle-type drug dissolution testing systems, this means that the length (L) of the brush body 20 can be less than the inner diameter of the vessel 4, as shown in FIGS. 2*a* and 2*b*.

Various brush designs may be used. In the embodiment of FIGS. 3*a*–3*c*, the brush body 20 is formed by closely spaced filaments 22 (e.g. approximately 10–30 microns diameter and about 6–12 mm in length) secured to the support member 18, which, in this case, is conveniently formed by a twisted pair of wires. This yields a helical pattern of filaments 22 about the support member 18, as best shown in FIG. 3*a*. Arranging the pitch (P) of the helix to be very much greater than the filament diameter, and keeping the filament density (i.e. the number of filaments per unit length of the support member), produces a very open brush structure which readily admits a flow of dissolution medium through the brush body 20. In general, the diameter of the filaments 22 will be selected to provide suitable properties of stiffness and wear resistance. The filament length and density can then be selected to balance the requirement for effective sweeping of the bottom of the vessel 4 while retaining an open brush structure which inefficiently transfers rotary motion of the brush body 20 to the dissolution medium 12. If desired, the filaments 22 above the support member may be cropped shorter than the filaments below the support member, as shown in FIG. 3*c*.

As shown in FIG. 4, during operation, the support member 18 applies a force (F) which biases the brush body into contact with the bottom of the vessel 4 (which, for illustrative purposes only, is shown as a flat surface in FIG. 4). Accordingly, rotation of the stirring element 16 causes the brush body 20 to "sweep" the bottom surface of the vessel 4. As the brush body 20 rotates, dissolution medium flows through the brush body (as shown by arrows 24 in FIG. 4), and creates a region of moderate-to-high turbidity 26 behind the brush body 20. In combination, the sweeping action of the brush body and the fluid turbidity effectively mobilize and disperse solid particles 28 of undissolved pharmaceutical product. Small particles 28*a* are forced into suspension within the dissolution medium 12. Particles 28*b* that are too large to be suspended within the dissolution medium are swept by the brush body 20 and dispersed across the surface of the vessel 4. In addition, some particles 28*c* become entrapped within the filaments 22 of the brush body 20, and will dissolve as the medium 12 flows across (and around) the filaments 22. As may be appreciated, in all cases, the accumulation of solid particles 28 (in a mound 14, see FIG. 1) is prevented. This, in turn, maximizes interaction between solid particles 28 and the dissolution medium 12, thereby maximizing the rate of dissolution.

The open structure of the brush body 20 is particularly beneficial for two reasons. First, rotary motion of the stirring element 16 is inefficiently transferred to the surrounding dissolution medium 12. This means that, while high turbidity is induced in the dissolution medium 12, relatively little bulk (rotary) movement of the dissolution medium 12 occurs. Even during dissolution tests over extended time periods, relatively little bulk rotation of the dissolution medium is observed. This result may be obtained when the stirring element 16 is rotated in one direction throughout the dissolution test. If desired, bulk rotation of the dissolution medium may be further reduced (if not entirely eliminated) by periodically reversing the direction of rotation of the stirring element 16 and/or inserting a fixed barrier (e.g. a this sheet of plastic or metal) into the vessel. In either case, the lack of bulk movement of dissolution medium means that there will be difference between the rotation speed of the stirring element 16 and the bulk rotation speed of the dissolution medium 12. Because this speed difference is a function of mechanical characteristics of the stirring element 16 which can be controlled within very narrow tolerances, the speed difference is readily repeatable (across successive sample runs, pharmaceutical products; and even testing machines). This, in turn, yields a second benefit, in that solid particles within the vessel will be subject to a closely repeatable fluid flow regime (e.g. flow rates through the brush body 20 and turbidity behind the brush body 20). In combination with the sweeping action of the brush body 20, which prevents accumulation of undissolved solid particles 28 on the bottom of the vessel 4, this highly repeatable fluid flow regime produces a highly repeatable (and reproducible) rate of drug dissolution.

Based on the forgoing, it will be seen that the stirring element of the present invention is designed to promote drug disintegration and dissolution by causing a high turbidity, low bulk movement fluid regime which disperses solid particles 28, and forces them to move relative to the dissolution medium 12. This differs markedly from prior art dissolution testing apparatus (particularly of the paddle type), which are designed to cause movement of the dissolution medium 12 relative to the vessel 4, and do not attempt to directly control interaction between the dissolution medium and the pharmaceutical product under test. It will also be seen that the high turbidity, low bulk movement fluid regime, coupled with particle dispersion due to the sweeping action of the brush body 20, is a far closer approximation of the conditions within the GI tract. It is therefore expected that drug dissolution test conduced in accordance with the present invention will show a far superior degree of correlation with bio-studies of the same pharmaceutical products.

In practice, selection of rotation speed is a balance between the desire to generate a consistently repeatable flow regime, while preventing mechanical disruption of the pharmaceutical product by the stirring element 16. The intent is to ensure that disintegration and dissolution of the pharmaceutical product is caused by interaction with the dissolution medium 12, rather than by mechanical effects (e.g. crushing, whipping or shearing) of the stirring element 16. The rotation speeds produced by conventional paddle-type testing systems (e.g. between 50 and 100 RPM) will normally satisfy this requirement, although the optimum speed will likely vary according to the precise construction of the stirring element 16 and the type (e.g. tablet, capsule etc), size and shape of the pharmaceutical product under test. Thus it is expected that determination of the optimum rotation speed for any given dissolution test protocol may be determined by experiment, using techniques well within the purview of those of ordinary skill in the art.

As may be appreciated, repeated use of the stirring element may lead to wear and/or permanent deformation of the brush body. Accordingly, the stirring element 16 includes a coupling 30 (see FIGS. 2*a*–2*b*) which transmits rotary motion from the drive unit 6, while biasing the brush body 20 into consistently repeatable contact with the bottom of the vessel 4. Such consistent contact may, for example, be provided by a bias force (F, see FIG. 4) that is substantially independent of the vertical position of the brush body 20 (at least within some predefined range). This ensures that substantially the same amount of filaments 22 are in contact with the bottom of the vessel 4, and thus ensures that the brush body 20 sweeps the bottom portion of the vessel 4 in a highly repeatable manner, over many successive dissolution testing runs. Such a bias force (F) may be generated in various ways. For example, the coupling 30 may incorporate a spring or a resilient elastomeric element (not shown). Alternatively, in embodiments in which the stirring element 16 has sufficient weight, the coupling 30 can be designed to allow free longitudinal sliding motion of the support member 18, so that gravity can be used to bias the brush body 20 into contact with the bottom of the vessel 4. If desired, steel or lead weights (not shown) may be added to the stirring element 16 (e.g. within the coupling 30, if desired) in order to obtain a suitable bias force. The coupling 30 can be made integral with an upper portion of the support member 18 or may be detachable, as desired.

Figure 5:
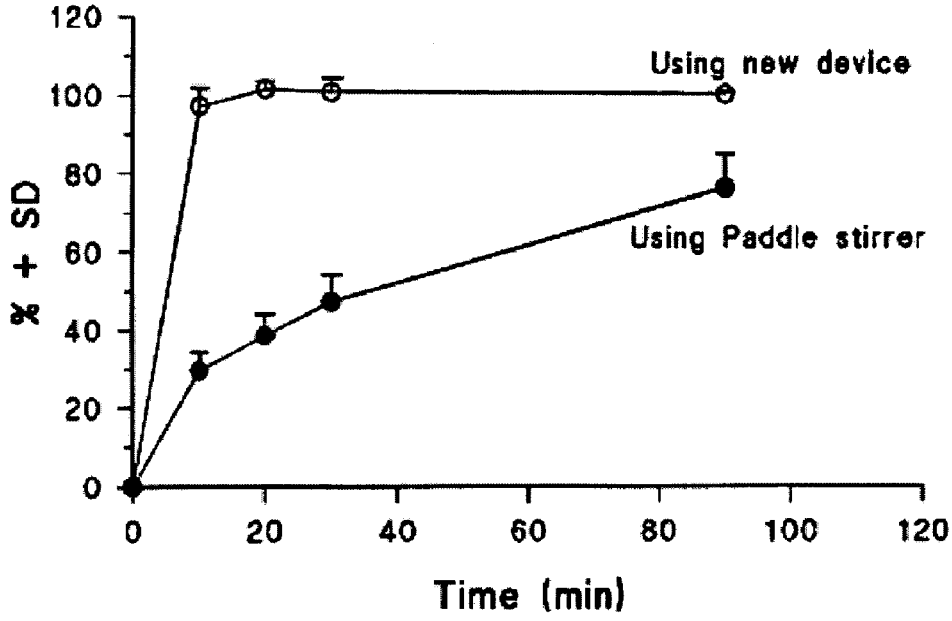
* and FIG. 5 is a graph showing exemplary comparative dissolution profiles obtained using the prior art paddle apparatus of FIG. 1 and the apparatus of the present invention.

FIG. 5 is a graph illustrating exemplary comparative dissolution profiles of the prior art paddle mixer and a mixing device in accordance with the present invention. In this example, drug release profiles of a commercially available 250 mg amoxicillin capsule product are described. The test product is a conventional release product i.e., fast-release drug product. Two sets of experiments were conducted using a 6-spindle dissolution apparatus with six identical dissolution vessels, each having 900 ml of dissolution medium. In one experiment, each spindle drove a prior art paddle mixer. In the other experiment, each spindle drove a stirring element in accordance with the present invention. In both experiments, the spindles were rotated at 50 rpm.

The bottom curve represents the percentage dissolution versus time for the prior art paddle stirrer. Although the product is a fast-release product by rapidly releasing the content of capsule shell, in this case the drug's appearance in solution is delayed due to poor interaction of the dissolution medium (liquid) with the drug product using the paddle stirrer. The dissolution curve seems to imply that the test product is a slower release product than it actually is.

The top curve represents the percentage dissolution versus time achieved using the present invention. In this case, the interaction of the dissolution medium with the product is enhanced using the present invention and the dissolution curve more accurately reflects dissolution characteristics of the fast drug release product.

The embodiment(s) of the invention described above is(are) intended to be exemplary only. The scope of the invention is therefore intended to be limited solely by the scope of the appended claims.

I claim:

1. A method for controlled dissolution of a pharmaceutical product in a dissolution medium contained within a vessel, the method comprising steps of:

inducing a flow regime within the vessel characterized by high turbidity and minimum bulk movement of the dissolution medium; and simultaneously mechanically dispersing solid particles of the pharmaceutical product on a bottom portion of the vessel;

wherein the steps of inducing a flow regime within the vessel and simultaneously dispersing solid particles comprise steps of:

providing a brush body adapted to sweep a bottom portion of the vessel;

repeatably biasing the brush body into sliding engagement with the bottom portion of the vessel and;

causing controlled rotation of the brush body within the vessel.

2. A method as claimed in claim 1, wherein the step of causing controlled rotation of the brush body comprises driving the brush body to rotate at a speed of between 10 and 150 RPM.

3. A method as claimed in claim 1, wherein the step of causing controlled rotation of the brush body comprises driving the brush body to rotate in a selected direction.

4. A method as claimed in claim 3, wherein the selected direction is constant for at least a duration of a dissolution test.

5. A method as claimed in claim 3, wherein the selected direction is reversed at least once during a dissolution test.

6. A method as claimed in claim 1, wherein the brush body comprises an open structure adapted to admit a flow of dissolution medium through the brush body due to rotation of the brush body within the vessel.

7. A method as claimed in claim 1, wherein the brush body comprises a plurality of closely spaced filaments secured in a helical pattern about a support member.

8. A method as claimed in claim 1, wherein the step of repeatably biasing the brush body into sliding engagement with the bottom portion of the vessel comprises a step of providing means for applying a consistently repeatable bias force to the brush assembly.

9. A method as claimed in claim 8, wherein the means for applying a consistently repeatable bias force comprises any one or more of:

a spring;

an elastomeric element; and a free-sliding coupling.

* * * * *